US005605376A

United States Patent [19]

Kogai

[11] Patent Number: 5,605,376

[45] Date of Patent: Feb. 25, 1997

[54] METHOD FOR INCLINING A CHAIR SEAT, AND CHAIR HAVING AN INCLINABLE SEAT

[75] Inventor: Koichi Kogai, Nissin Cho, Japan

[73] Assignee: AIKO Co., Ltd., Nagoya, Japan

[21] Appl. No.: 408,384

[22] Filed: Mar. 22, 1995

[30] Foreign Application Priority Data

Apr. 12, 1994 [JP] Japan ..... 6-097999

[51] Int. Cl.[6] ..... A47C 3/00

[52] U.S. Cl. ..... 297/300.5; 297/316

[58] Field of Search ..... 297/302.1, 302.4, 297/300.1, 300.2, 300.5, 316, 319

[56] References Cited

U.S. PATENT DOCUMENTS 3,092,415 6/1963 Schliephacke .
4,640,547 2/1987 Fromme .
4,640,548 2/1987 Desanta ..... 297/300.1 X
4,966,411 10/1990 Katagiri et al. .
5,029,940 7/1991 Golynsky et al. .

*Primary Examiner*—Milton Nelson, Jr.
*Attorney, Agent, or Firm*—Wenderoth, Lind & Ponack

[57] ABSTRACT

According to a method for inclining a chair seat, and a chair having an inclinable seat, blood circulation is improved by making the structure of the chair simple and of such a structure as to cause elongating of the backbone of a person being seated, and dissipating of the pressure at the rear side of the femoral region in the vicinity of the knees. In this chair, a backrest attaching member is pivotally supported at the rear side of an attaching frame for rearward inclination, and at the same time is spring-pressed toward the attaching frame. A push-up member is vertically attached to a horizontal portion of the backrest attaching member. A seat receiving plate is pivotally supported at the front side of the attaching frame for upward inclination, and the seat receiving plate is engaged with an upper end of the push-up member. A backrest is attached to the backrest attaching member, and a seat is attached to the seat receiving plate. With this arrangement, the backrest side of the seat is upwardly inclined by causing the backrest to be inclined rearwardly.

19 Claims, 7 Drawing Sheets

METHOD FOR INCLINING A CHAIR SEAT, AND CHAIR HAVING AN INCLINABLE SEAT

BACKGROUND OF THE INVENTION

The present invention relates to a method for inclining a chair seat, by which the backrest side of the seat is inclined upward when being seated, and to a chair having an inclinable seat.

Conventionally, such devices where the seat is caused to move forward in line with the rearward inclination of the backrest or the backrest side of the seat is inclined downward via a complicated link mechanism have been known as structures which do not adversely influence a human body when being seated.

In the arrangements described above, a chair is internally provided with a complicated link mechanism, and the number of manufacturing process is increased causing the production work to be slowed down and the production cost to be increased.

In a case where the seat is caused to move forward in line with rearward inclination of the backrest when a person is being seated, the backbone is not allowed to be elongated, burdens are likely to be imposed on the waist, and the center of gravity is moved from the buttocks to the knee side (the load of a person being seated is concentrated at the rear side of the femoral region in the vicinity of the knee). Therefore, the rear side of the femoral region near the knee is subjected to more pressure, thereby causing the blood vessels to be pressed and the circulation of the blood to be hindered. Accordingly, such a problem exists that fatigue and sensitivity to the cold can not be eliminated.

Furthermore, in a case where the backrest side seat is inclined rearward in line with rearward inclination of the backrest, the backbone is not allowed to be elongated as in the above case, and burdens are likely to be imposed on the waist, thereby causing the degree of angle formed by the femoral region and leg to be acute and the heel to be likely to be lifted up from the floor level. Therefore, the calf of the leg is apt to be strained, and the load of a person being seated is concentrated to the rear side of the femoral region in the vicinity of the knee causing a greater pressure to be exerted at the rear side of the femoral region. Accordingly, the blood vessels are pressed and the circulation of the blood is adversely affected, and such a problem exists that fatigue and sensitivity to the cold can not be eliminated.

Furthermore, from the biotechnological standpoint, it is well known that the blood vessels are pressed by the rear side of the femoral region in the vicinity of the knees which are subject to a load (the load being given due to the body weight) when being seated, thereby resulting in fatigue and sensitivity to the cold.

SUMMARY OF THE INVENTION

In view of the foregoing, it is an object of the invention to provide a method for inclining a chair seat, and to provide a chair having an inclinable seat. The chair is comfortable to a human body and the structure thereof is simple, allowing straight elongation of the backbone of a person being seated, thereby dissipating the pressure at the rear side of the femoral region near the knee to allow the blood circulation to be much improved.

It is possible with the present structure to decrease the number of manufacturing processes, to shorten the work time, and to remarkably reduce the production cost, etc.

Furthermore, as a backrest side of the seat is upwardly inclined in line with the rearward inclination of the backrest, it is possible to straighten and elongate the backbone of a person being seated and to prevent the heels from being lifted upward from the floor level. Therefore, it is possible to prevent the calf of the legs from being strained, and at the same time, to dissipate the load of a person being seated to the entire area of the rear side of the femoral region, thereby causing the pressure at the rear side of the femoral region in the vicinity of the knees to be dissipated. Therefore, the blood circulation of a person being seated will be much improved, thereby removing the cause of fatigue and sensitivity to the cold.

The foregoing object of the invention has been achieved by the provision of a method in which the backrest and a backrest attaching member, consisting of a horizontal portion and a vertical portion are inclined rearwardly. The backrest and its attaching member are pivotally supported for inclination rearwardly at one side of an attaching frame. The attaching frame has a bottom plate attached to the upper part of a leg portion and side plates and the horizontal portion of the backrest attaching member is spring-pressed toward the bottom plate of the attaching frame. A push-up member is attached to and projected upwardly from the horizontal portion of the backrest attaching member and engages with the underside of the seat receiving plate, which is pivotally supported inclinably upward at the rear end of the attaching frame. When the backrest is inclined rearwardly, the front end of the horizontal portion of the backrest attaching member, and thus the push-up member, are moved upwardly, to cause upward movement of the rear end of the seat receiving plate and thus rearward and upward inclining of the seat.

The bottom plate of the attaching frame is installed at the upper end of a supporting column provided at the leg portion, the backrest attaching member is L-shaped consisting of the horizontal portion and the vertical portion, and the horizontal portion is pivotally supported by the attaching frame so that it is inclinable rearwardly. The horizontal portion of the backrest attaching member is pushed toward the bottom plate of the attaching frame by a spring, and the seat receiving plate is pivotally supported to incline rearwardly and upwardly at the front end of the attaching frame, with rear end of the seat receiving plate being engaged with the upper end of the push-up member. Thus, the backrest is attached to the backrest attaching member and the seat is attached to the seat receiving plate.

BRIEF DESCRIPTION OF THE DRAWINGS

Other features and advantages of the invention will be apparent from the following description taken in connection with the accompanying drawings wherein.

DETAILED DESCRIPTION OF THE PREFERRED EMBODIMENT

Figure 1:
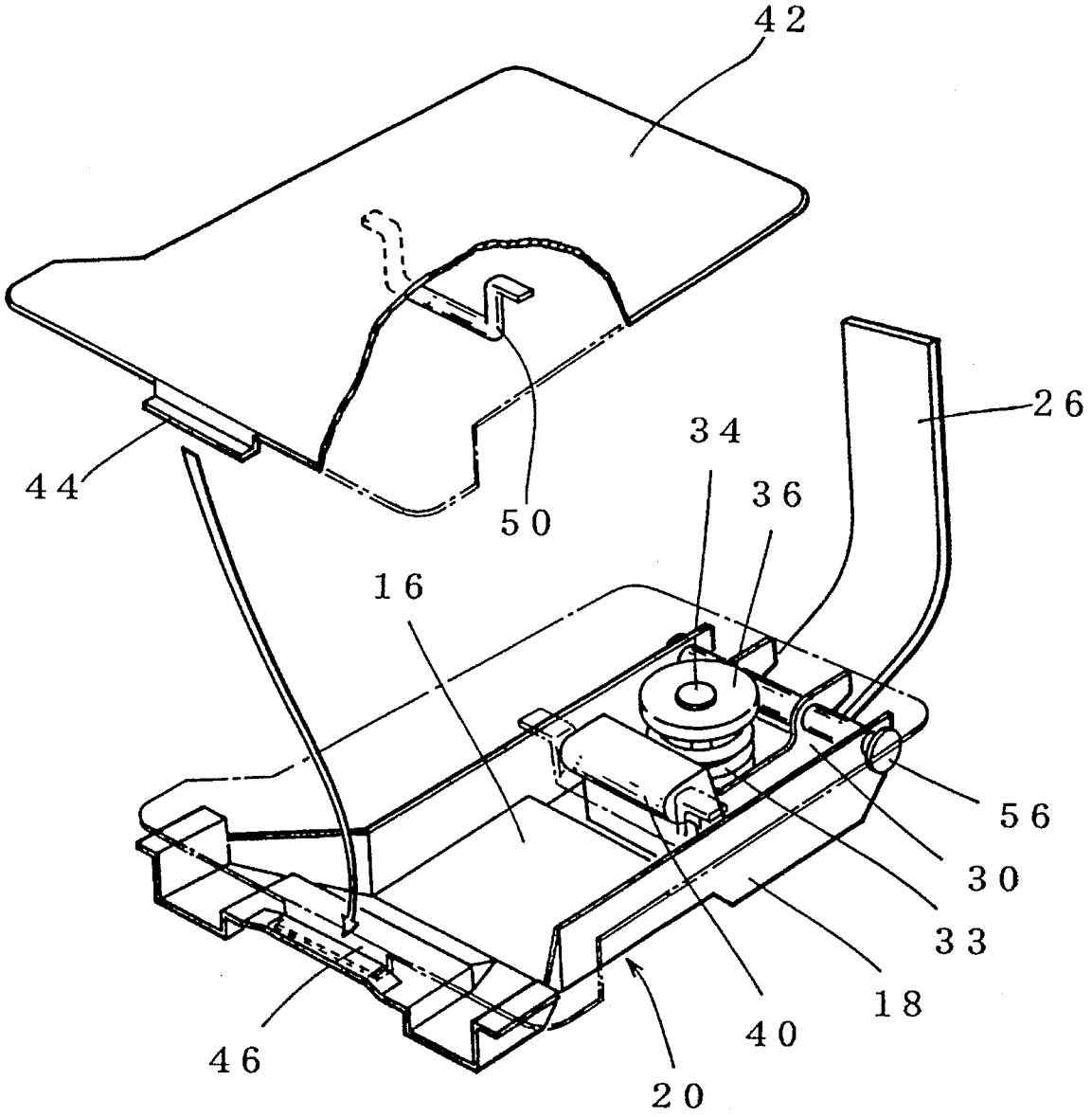
FIG. 1 is a disassembled perspective view showing the internal structure of a chair equipped with an inclinable seat according to the invention.

A description will be given of the actions of the invention.

When the backrest is caused to move rearwardly with a person seated on a chair having an inclinable seat according to the invention, the heavier the weight of the person, the more the elastic force of action (backrest load) of the backrest against the back of a person being seated is increased. The lighter the weight of the person being seated, the weaker is the elastic force of action against the back of the person being seated. Therefore, the force of action of the backrest against the back of the person being seated constantly acts in correspondence to the weight of the person. So the person being seated will not feel that the backrest is hard or soft, and a comfortable seating will be secured.

Furthermore, when causing the backrest to be inclined rearwardly against the pressing force (elasticity) of the backrest attaching member when being seated, the push-up member attached to and projecting upwardly from the horizontal portion of the backrest attaching member is lifted while the pivotal supporting part of the attaching frame of the backrest attaching member is used as a fulcrum according to the lever principle, and the seat receiving plate which is engaged with the push-up member is inclined upward about the pivotal supporting part of the seat receiving plate at the front side of the attaching frame.

Accordingly, the backrest side of the seat is inclined upward (i.e. the rear of the seat is lifted upwardly so that the seat is inclined downwardly and forwardly) upon a person being seated, thereby causing the backrest to be inclined rearwardly.

Therefore, the backbone of the person being seated is straightened and elongated, and the heels are not lifted up from the floor level, thereby causing the calf of the legs to be prevented from being strained and the load of the person being seated to be dissipated to the entire area at the rear side of the femoral region of the person being seated. Therefore, the pressure at the rear side of the femoral region near the knees is dissipated to allow the blood circulation to be much improved, and thus fatigue and sensitivity to the cold can be eliminated.

A chair having an inclinable seat according to the invention is such that the backrest 10 thereof is inclinable rearwardly, and is composed as shown in FIG. 1 to FIG. 4.

An attaching frame 20, consisting of the bottom plate 16 and side plates 18 projected upwardly at the circumference of the bottom plate 16, is provided at the upper end of a supporting column 14 attached to and extending upwardly from the leg portion 12. In the preferred embodiment, a height-adjustable gas spring is incorporated in the supporting column 14.

An L-shaped backrest attaching member 26, consisting of a horizontal portion 30 and a vertical portion 24 is pivotally supported so as to be inclined rearwardly between the side plates 18 at one side (the right side in FIG. 1 to FIG. 3) of the attaching frame 20. In the preferred embodiment, the horizontal portion of the backrest attaching member 26 comprises a box-like locking member and is inserted into and pivotally supported in the attaching frame 20, and the vertical portion comprises an L-shaped body and is connected to one side of the locking member 30.

A bottom plate portion 32 (horizontal portion) of the locking member 30 of the backrest attaching 26 is spring-pressed toward the bottom plate 16 of the attaching frame 20 by a spring-pressing means.

In the preferred embodiment, the spring-pressing means is a coil spring 33, which is attached to and connected to an adjusting bolt 34 attached to and inserted into the bottom plate portion 32 of the locking member 30 and the attaching frame 20 from below the attaching frame 20. A spring receiver 36 is screwed into the end portion of the adjusting bolt 34, and an adjusting knob 38 is attached to the end of the adjusting bolt 34 at the rear side of the attaching frame 20.

Furthermore, in detail, the coil spring 33 is fitted between a fitting concave portion (not illustrated) provided at the upper side of the bottom plate 32 of the locking member 30, and another fitting concave portion (not illustrated) provided at the lower side of the spring receiver 36, and the adjusting bolt 34 is screwed into the spring receiver 36.

Namely, by turning the adjusting bolt 34 via the adjusting knob 38, the spring receiver 36 is vertically elevated and lowered with the adjusting bolt 34. Thereby, the coil spring 34 is elongated and shortened to adjust the elasticity of the coil spring 33.

Therefore, by causing the adjusting knob 34 to turn, it is possible to adjust the elasticity of the coil spring 33 which controls the pressure exerted by the backrest attaching member 26 on the back of a person being seated.

A push-up member 40 is attached to and stands at the end portion (the left edge in FIG. 1 to FIG. 3) of the bottom plate portion 32 (horizontal portion) of the box-like locking member 30 of the backrest attaching member 26. In the preferred embodiment, the push-up member 40 is an inverted L-shaped plate member, and is of such a dimension that a seat receiving plate 42 (described later) is inclined upward about three degrees (the angle which is considered to be optimal) above the horizontal direction.

The seat receiving plate 42 is pivotally supported for inclination between the side plates 18 at the other side (the left side in FIG. 1 to FIG. 3) of the attaching frame 20 in such a state that one side (the right side in FIG. 1 to FIG. 3) of the seat receiving plate 42 is engaged with the upper end of the push-up member 40 vertically attached to the locking member 30. In the preferred embodiment, the pivotally supporting means of the seat receiving plate 42 and attaching frame 20 is established by engagement of an engagement flange 44 provided at the front of seat receiving plate 42 with an engaging opening 46 provided at the front of the attaching frame 20.

The backrest 10 is attached to the backrest attaching member 26, and a seat 48 is attached to the seat receiving plate 42.

Figure 2:
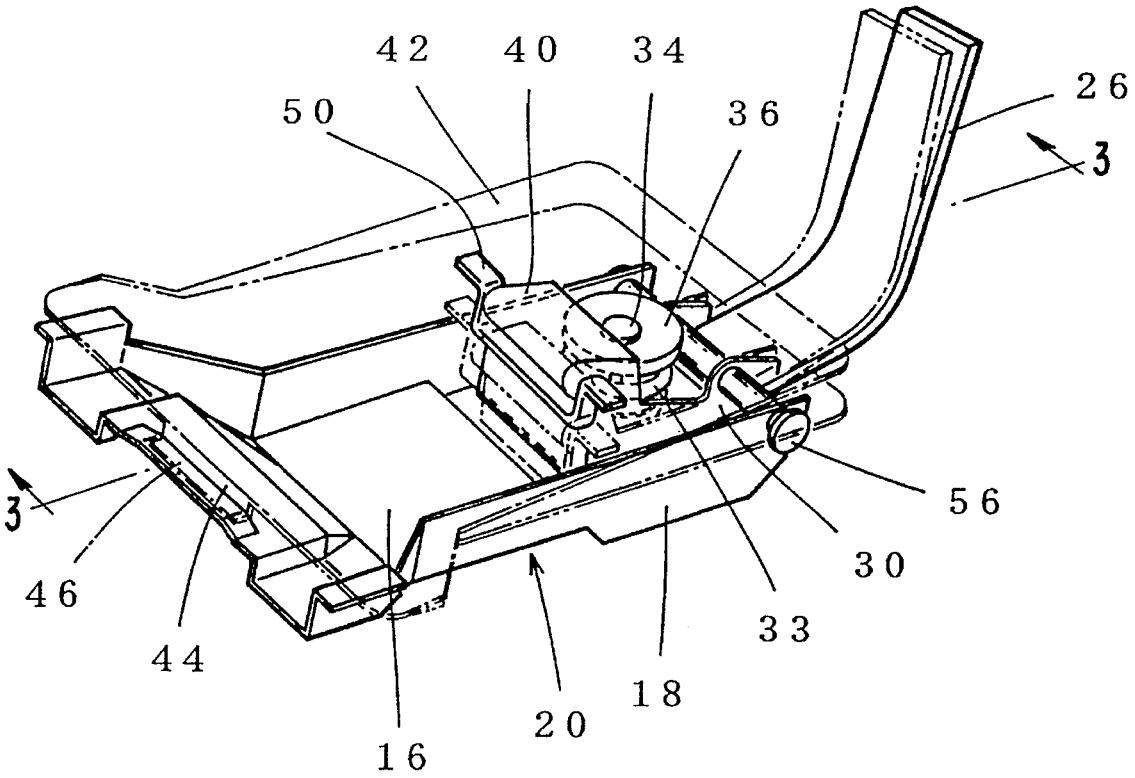
FIG. 2 is an assembled perspective view showing the same.
Figure 3:
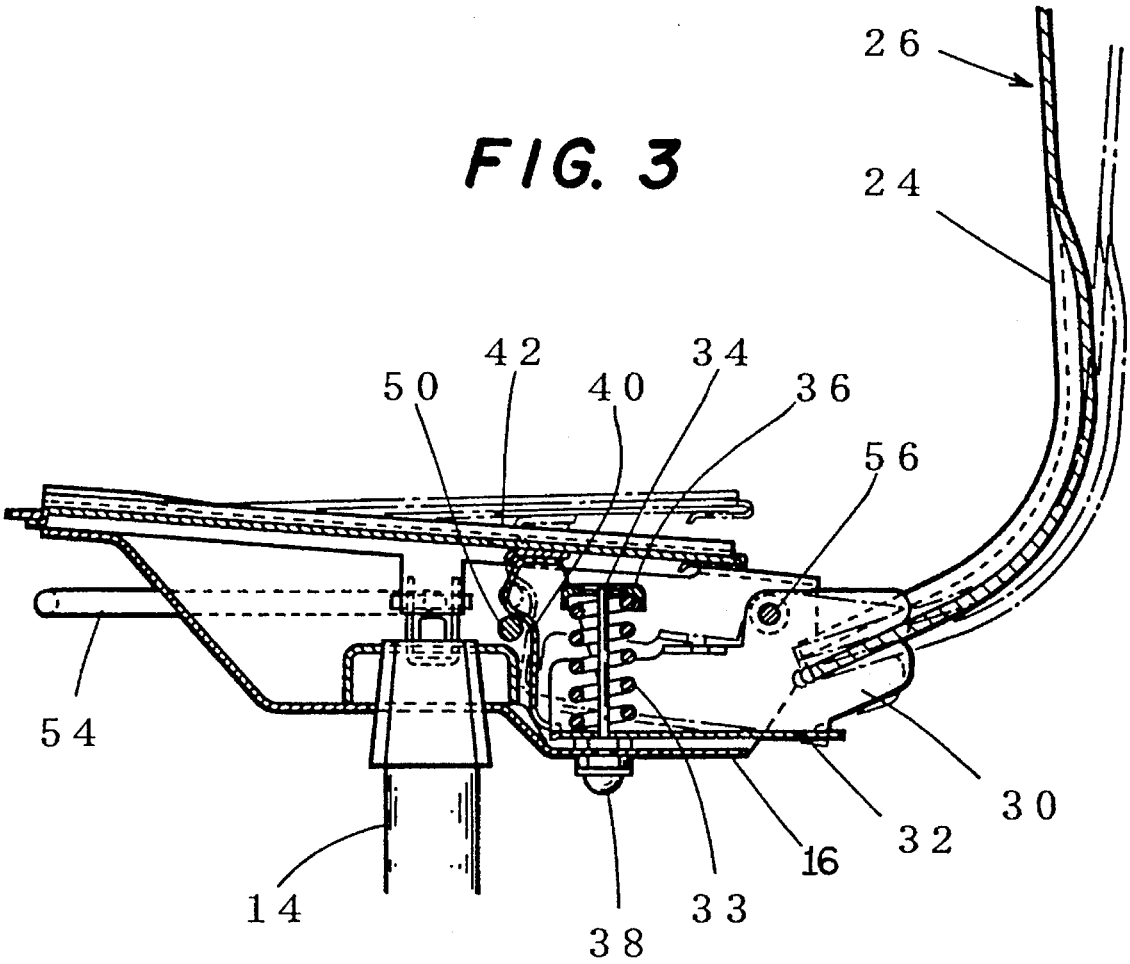
FIG. 3 is a longitudinal sectional view taken along line 3—3 of FIG. 2.
Figure 4:
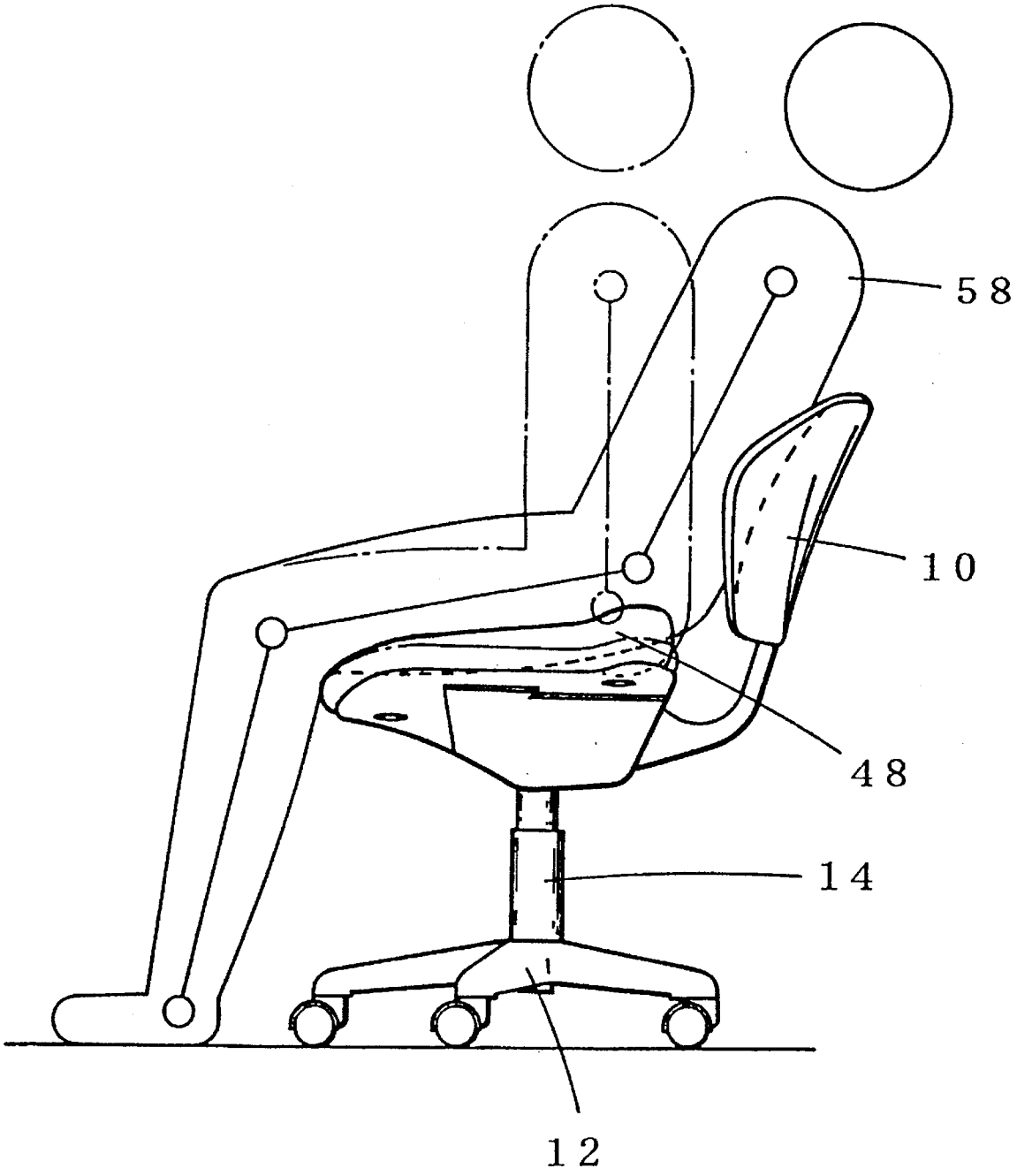
FIG. 4 is a side elevational view showing a use state of a chair equipped with an inclinable seat according to the invention.
Figure 5:
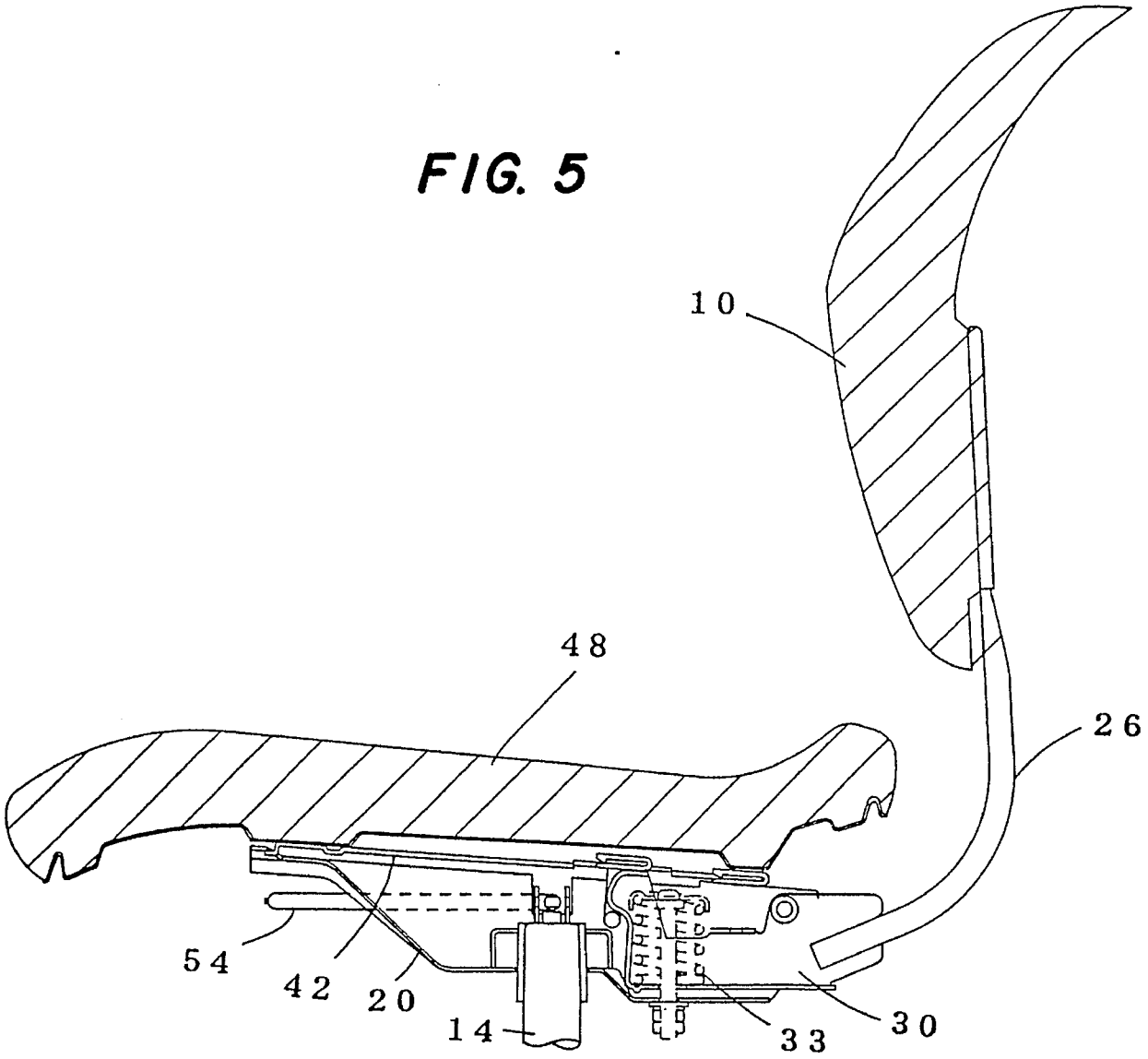
FIG. 5 is a perspective view of the chair with the seat and backrest in rest positions.
Figure 6:
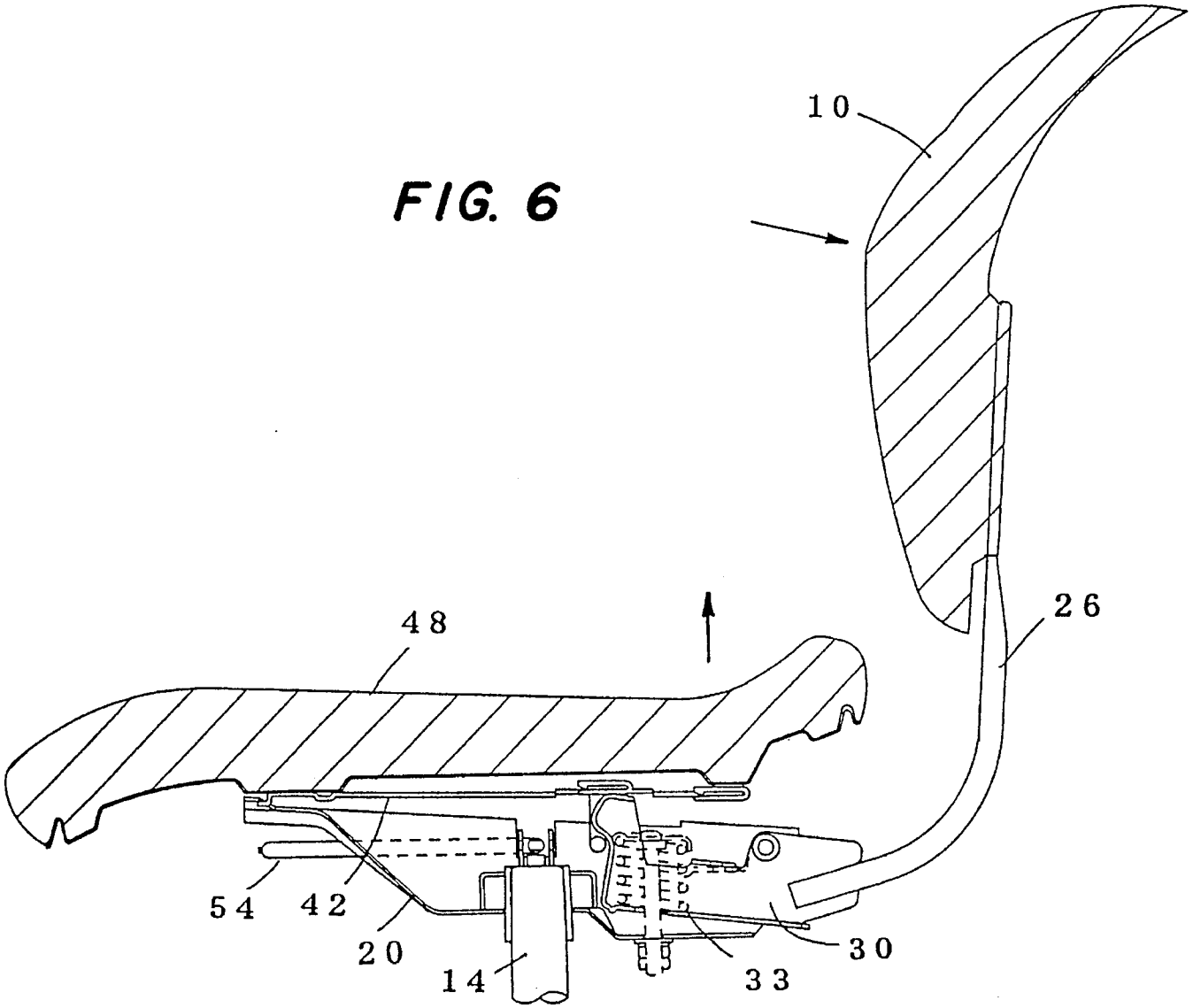
FIG. 6 is a perspective view of the chair with the seat and backrest in inclined positions.
Figure 7:
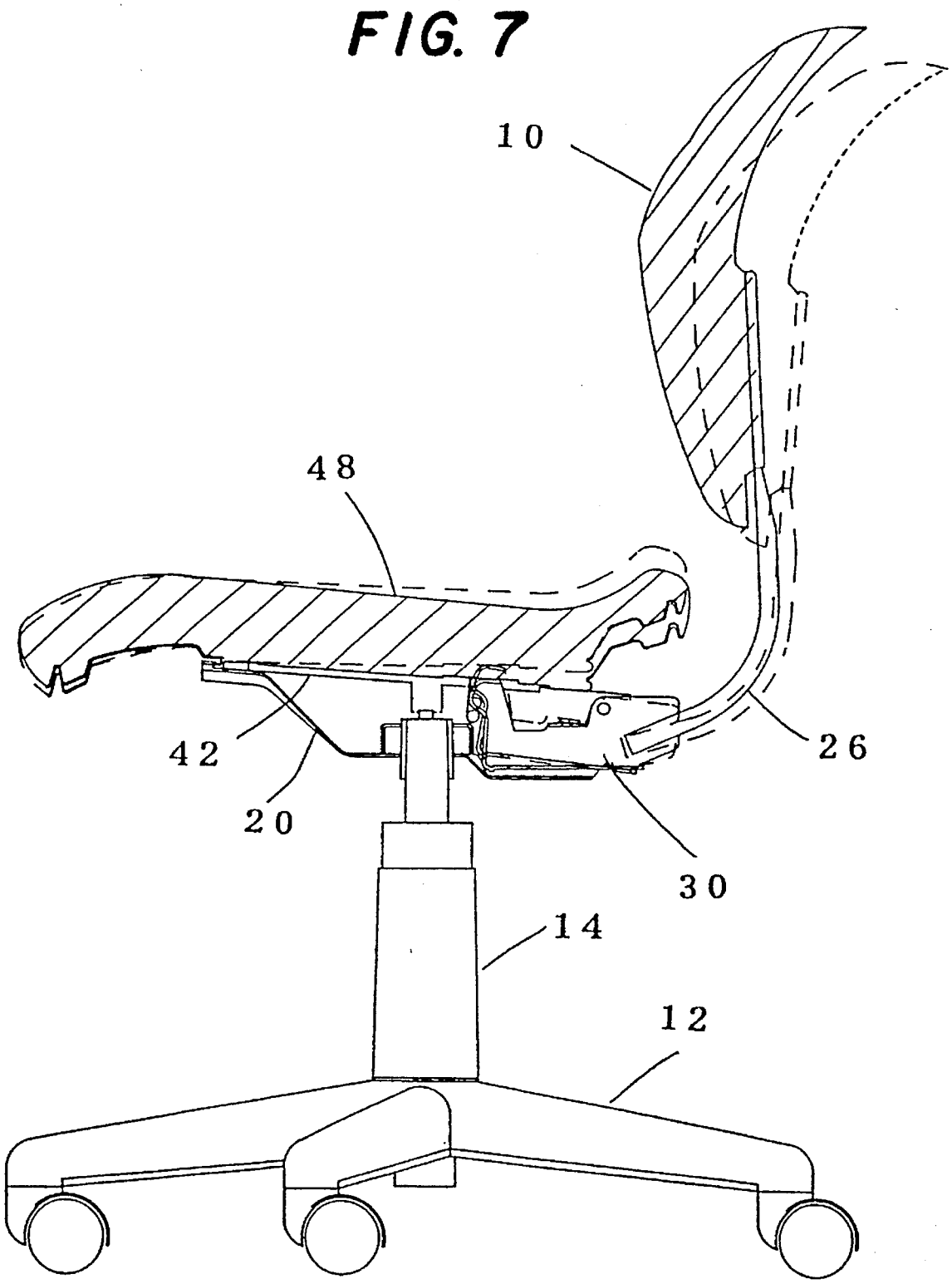
FIG. 7 is a perspective view showing the chair with the seat and backrest in both their rest positions (solid lines) and their inclined positions (phantom lines).

Furthermore, in the drawings, 50 is a stopper of the seat 48 attached to the rear side of the seat receiving plate 42, which is idly engaged with the push-up member 40. The stopper prevents the seat 48 from coming off when the seat 48 is lifted, and at the same time supports the seat 48 on the attaching frame when being seated. In FIG. 1, the stopper is shown at both the attaching frame 20 side (by phantom lines) and the seat receiving plate 42 side (by solid lines), respectively, for the sake of the explanation thereof. Actually, however, there is only one stopper as shown in FIG. 2 and FIG. 3.

Furthermore, 54 is an elevation regulating lever of the supporting column 14, 56 is supporting (pivot) pin, and 58 is a person being seated.

A description will be given of a method for upwardly inclining the seat 48 at the backrest 10 side of a chair according to the invention.

The push-up member 40 vertically attached to the bottom plate portion 32 of the box-like locking member 30 connected to the backrest attaching member 26 is caused to be lifted up by the lever principle with the pivotal pivot pin 56 as a fulcrum, rearward inclination of the backrest 10 against the spring pressing force (the elasticity of the coil spring 33) of the backrest attaching member 26. Upon such lifting of the push-up member 40, the seat receiving plate 42 which is engaged with the push-up member 40 is upwardly inclined by about 3 degrees (the angle which seems to be optimal) with the engagement flange (the pivotally supporting point) of the seat receiving plate 42 acting as a seat fulcrum at the front of the attaching frame 20.

Furthermore, in the preferred embodiment, the supporting column 14 is internally provided with a height-adjustable gas spring. However, any other height adjusting means may be utilized or such height adjusting means may be omitted.

Still furthermore, in the preferred embodiment, although the backrest attaching member comprises the L-shaped vertical portion 24 separate from the locking member 30, the respective members may be made integral.

Furthermore, in the preferred embodiment, although a spring-pressing means of the backrest attaching member 26 is located between the push-up member 40 and the pivotally supporting point (i.e. pivot pin 56) of the attaching frame 20 and the backrest attaching member 26, it is also possible for the push-up member 40 to be vertically attached closer to the pivotal supporting portion (i.e. the pivot pin 56) and the spring pressing means to be located to the left of the push-up member 40 as shown in FIG. 1 to FIG. 3.

Furthermore, in the preferred embodiment, although an adjusting knob 38 is mounted at the end portion of an adjusting bolt 34 in order to adjust the spring pressing means (coil spring 33), a nut corresponds to the adjusting bolt 34 can be used in place of the knob 38.

Furthermore, in the preferred embodiment, although a pivotal support between the seat receiving plate 42 and the attaching frame 20 is effected by the engagement of an engagement flange 44 with an engaging opening 46, a supporting pin which is similar to the pivotally supporting means between the attaching frame 20 and the backrest attaching member 26 may be used instead of any other pivotally supporting means may be adopted.

What is claimed is:

1. A chair comprising:

a leg portion;

a supporting column extending upwardly from said leg portion;

an attaching frame mounted to an upper end of said supporting column, said attaching frame having a front end and a rear end;

a generally L-shaped backrest attaching member having a substantially vertical backrest-receiving portion and a substantially horizontal portion pivotally attached to said rear end of said attaching frame for pivotal motion relative thereto about a first substantially horizontal pivot axis to allow said substantially vertical backrest-receiving portion to be moved in forward and rearward directions;

a seat receiving plate having a front end and a rear end, said seat receiving plate being pivotally mounted to said attaching frame for pivotal movement about a second substantially horizontal pivot axis; and a push-up member attached to and extending upwardly from said substantially horizontal portion of said backrest attaching member at a position of said substantially horizontal portion located forwardly of said first substantially horizontal pivot axis, said push-up member having an upper end engaged against an underside of said seat receiving plate at a position on said seat receiving plate located rearwardly of said second substantially horizontal pivot axis.

2. A chair as recited in claim 1, further comprising a spring pressing means for pressing said substantially horizontal portion of said backrest attaching member in a direction to pivot downwardly about said first substantially horizontal pivot axis toward a rest position.

3. A chair as recited in claim 1, wherein said backrest attaching member comprises a bottom plate and side plates provided at peripheral edges of said bottom plate.

4. A chair as recited in claim 3, wherein said second substantially horizontal pivot axis is located at said front end of said seat receiving plate.

5. A chair as recited in claim 4, wherein said first and second substantially horizontal pivot axes are substantially parallel to one another.

6. A chair as recited in claim 1, wherein said second substantially horizontal pivot axis is located at said front end of said seat receiving plate.

7. A chair as recited in claim 6, wherein said first and second substantially horizontal pivot axes are substantially parallel to one another.

8. A chair as recited in claim 1, wherein said first and second substantially horizontal pivot axes are substantially parallel to one another.

9. A chair as recited in claim 1, wherein said push-up member constitutes a means for rearwardly and upwardly inclining said seat receiving plate about said second substantially horizontal pivot axis when said substantially vertical backrest receiving portion of said backrest attaching member is moved rearwardly to cause pivoting of said substantially horizontal portion of said backrest attaching member about said first substantially horizontal pivot axis.

10. A chair comprising:

a leg portion;

a supporting column extending upwardly from said leg portion;

an attaching frame mounted to an upper end of said supporting column, said attaching frame having a front end and a rear end;

a generally L-shaped backrest attaching member having a substantially vertical backrest-receiving portion and a substantially horizontal portion pivotally attached to said rear end of said attaching frame for pivotal motion relative thereto about a first substantially horizontal pivot axis to allow said substantially vertical backrest-receiving portion to be moved in forward and rearward directions;

a seat receiving plate having a front end and a rear end, said seat receiving plate being pivotally mounted to said attaching frame for pivotal movement about a second substantially horizontal pivot axis; and a push-up member attached to and extending upwardly from said substantially horizontal portion of said backrest attaching member and constituting a means for rearwardly and upwardly inclining said seat receiving plate about said second substantially horizontal pivot axis when said substantially vertical backrest receiving portion of said backrest attaching member is moved rearwardly to cause pivoting of said substantially horizontal portion of said backrest attaching member about said first substantially horizontal pivot axis.

11. A chair as recited in claim 10, further comprising a spring pressing means for pressing said substantially horizontal portion of said backrest attaching member in a direction to pivot downwardly about said first substantially horizontal pivot axis toward a rest position.

12. A chair as recited in claim 10, wherein said backrest attaching member comprises a bottom plate and side plates provided at peripheral edges of said bottom plate.

13. A chair as recited in claim 12, wherein said second substantially horizontal pivot axis is located at said front end of said seat receiving plate.

14. A chair as recited in claim 13, wherein said first and second substantially horizontal pivot axes are substantially parallel to one another.

15. A chair as recited in claim 10, wherein said second substantially horizontal pivot axis is located at said front end of said seat receiving plate.

16. A chair as recited in claim 15, wherein said first and second substantially horizontal pivot axes are substantially parallel to one another.

17. A chair as recited in claim 10, wherein said first and second substantially horizontal pivot axes are substantially parallel to one another.

18. A method comprising the steps of:

providing a chair comprising a leg portion, a supporting column extending upwardly from said leg portion, an attaching frame mounted to an upper end of said supporting column, said attaching frame having a front end and a rear end, a generally L-shaped backrest attaching member having a substantially vertical backrest-receiving portion and a substantially horizontal portion pivotally attached to said rear end of said attaching frame for pivotal motion relative thereto about a first substantially horizontal pivot axis to allow said substantially vertical backrest-receiving portion to be moved in forward and rearward directions, a seat receiving plate having a front end and a rear end, said seat receiving plate being pivotally mounted to said attaching frame for pivotal movement about a second substantially horizontal pivot axis, and a push-up member attached to and extending upwardly from said substantially horizontal portion of said backrest attaching member; and rearwardly and upwardly inclining said seat receiving plate about said second substantially horizontal pivot axis by moving said substantially vertical backrest-receiving portion of said backrest attaching member rearwardly to cause pivoting of said substantially horizontal portion of said backrest attaching member about said first substantially horizontal pivot axis to thereby raise said push-up member and cause said push-up member to push up against said rear end of said seat receiving plate.

19. A method as recited in claim 18, wherein in said step of rearwardly and upwardly inclining said seat receiving plate, said substantially vertical backrest-receiving portion of said backrest attaching member is moved rearwardly against a spring bias force acting on said substantially horizontal portion of said backrest attaching member.

* * * * *